US008544568B2

(12) United States Patent
Maurstad et al.

(10) Patent No.: US 8,544,568 B2
(45) Date of Patent: Oct. 1, 2013

(54) SHOULDER DURABILITY ENHANCEMENT FOR A PDC DRILL BIT USING SECONDARY AND TERTIARY CUTTING ELEMENTS

(75) Inventors: Cary Andrew Maurstad, Friendswood, TX (US); Zane Michael Pettiet, Tomball, TX (US)

(73) Assignee: Varel International, Inc., L.P., Carrollton, TX (US)

( * ) Notice: Subject to any disclaimer, the term of this patent is extended or adjusted under 35 U.S.C. 154(b) by 368 days.

(21) Appl. No.: 12/960,926

(22) Filed: Dec. 6, 2010

(65) Prior Publication Data

US 2012/0138365 A1 Jun. 7, 2012

(51) Int. Cl.
*E21B 10/46* (2006.01)

(52) U.S. Cl.
USPC ..... 175/378; 175/377; 175/431

(58) Field of Classification Search
USPC ..... 175/377, 378, 431
See application file for complete search history.

(56) References Cited

U.S. PATENT DOCUMENTS

| | | | | |
|---|---|---|---|---|
| 4,429,755 | A | 2/1984 | Williamson | |
| 4,545,441 | A | 10/1985 | Williamson | |
| 4,586,574 | A | 5/1986 | Grappendorf | |
| 4,907,662 | A | 3/1990 | Deane et al. | |
| 5,186,268 | A | 2/1993 | Clegg | |
| 5,346,025 | A | 9/1994 | Keith et al. | |
| 5,549,171 | A | 8/1996 | Mensa-Wilmot et al. | |
| 5,551,522 | A | 9/1996 | Keith et al. | |
| 5,582,261 | A | 12/1996 | Keith et al. | |
| 5,592,996 | A | 1/1997 | Keith et al. | |
| 5,607,024 | A | 3/1997 | Keith et al. | |
| 5,607,025 | A | 3/1997 | Mensa-Wilmot et al. | |
| 5,651,421 | A | 7/1997 | Newton et al. | |
| 5,904,213 | A * | 5/1999 | Caraway et al. | 175/393 |
| 5,957,227 | A | 9/1999 | Besson et al. | |
| 6,164,394 | A | 12/2000 | Mensa-Wilmot et al. | |
| 6,564,886 | B1 | 5/2003 | Mensa-Wilmot et al. | |
| 6,615,934 | B2 | 9/2003 | Mensa-Wilmot | |
| 7,703,557 | B2 * | 4/2010 | Durairajan et al. | 175/426 |
| 7,861,809 | B2 * | 1/2011 | Gavia et al. | 175/431 |
| 8,100,202 | B2 * | 1/2012 | Durairajan et al. | 175/426 |
| 2006/0070771 | A1 * | 4/2006 | McClain et al. | 175/57 |
| 2007/0199739 | A1 * | 8/2007 | Schwefe et al. | 175/426 |

(Continued)

OTHER PUBLICATIONS

International Search Report and Written Opinion for PCT/US2011/050936 mailed Mar. 23, 2012 (9 pages).

*Primary Examiner* — Jennifer H Gay
(74) *Attorney, Agent, or Firm* — Gardere Wynne Sewell LLP; Andre M. Szuwalski

(57) ABSTRACT

A PDC bit includes a plurality of blades. A blade includes a primary cutter row and a secondary cutter row. Primary PDC cutters on the primary cutter row are set in accordance with a single set methodology. Backup PDC cutters on the secondary cutter row are set in accordance with a methodology wherein a radial position of each backup PDC cutter in the secondary cutter row is offset from a radial position of each primary PDC cutter in the primary cutter row. The blade further includes a tertiary cutter row. Additional backup PDC cutters on the tertiary cutter row are set in accordance with a methodology wherein a radial position of each additional backup PDC cutter in the tertiary cutter row is offset from a radial position of each primary PDC cutter in the primary cutter row. The backup cutter setting methodology is effectively radially positions the included backup PDC cutters (in the secondary cutter row and/or tertiary cutter row) between primary PDC cutters in the primary cutter row.

22 Claims, 13 Drawing Sheets

(56) References Cited

U.S. PATENT DOCUMENTS

2008/0135297 A1* 6/2008 Gavia ..... 175/57
2008/0179106 A1 7/2008 Gavia et al.
2008/0179107 A1* 7/2008 Doster ..... 175/431
2008/0179108 A1* 7/2008 McClain et al. ..... 175/431
2008/0302575 A1 12/2008 Durairajan et al.
2009/0266619 A1 10/2009 Durairajan et al.
2011/0192651 A1* 8/2011 Lyons et al. ..... 175/428
2012/0138365 A1* 6/2012 Maurstad et al. ..... 175/57

* cited by examiner

SHOULDER DURABILITY ENHANCEMENT FOR A PDC DRILL BIT USING SECONDARY AND TERTIARY CUTTING ELEMENTS

TECHNICAL FIELD

The present invention relates generally to earth boring bits, and more particularly to bits which use polycrystalline diamond compact (PDC) cutters mounted to bit blades for drilling a variety of rock types.

BACKGROUND

Polycrystalline diamond compact (PDC) drill bits are set with PDC cutters mounted to bit blades. Many methods for defining the setting patterns for such PDC cutters are known in the art. The goals to be achieved with respect to any PDC cutter setting pattern include: enhancing the force balancing of the drill bit; improving the cleaning of the bit face; evening out the wear of the cutters across the bit face; improving the durability of the bit; and achieving improved rates of penetration by more effectively attacking the rock to be drilled.

Reference is now made to FIG. 1. One commonly used pattern for setting the locations of PDC cutters is referred to as the "single set" method. In the single set method, each PDC cutter 20 that is positioned across the face of the bit is given a unique radial position measured from the center axis 22 of the bit outwards towards the gage 24. One commonly utilized technique for implementing a single set pattern is to define a spiral function 26 originating at the bit center axis 22 and then place individual PDC cutters at points 28 where the spiral function intersects each blade 30 location. The spiral-blade intersection points 28 will each be located at a distinct radial distance from the bit axis 22. FIG. 1 shows a cutter layout diagram for an exemplary implementation of the single set method to position cutters on a bit with six blades 30.

Reference is now made to FIG. 2. Another commonly used pattern for setting the locations of PDC cutters is referred to as the "plural set" method. In the plural set method (also known as "redundant cutter" or "tracking cutter" method), PDC cutters 20 are deployed in sets 32 containing two or more cutters each, wherein the cutters of a given set are positioned at a same radial distance 34 from the bit axis, but are located on different blades 30. The leading cutter in the set 32 is referred to as a "primary" cutter (P) (positioned, for example, on a primary blade), and the trailing cutter in the set 32 is referred to as the "secondary" cutter (S) (positioned, for example, on a secondary blade). The included primary cutters P are typically set using the single set method described above and illustrated in FIG. 1. Because of the reduced area near the center of the bit face not every PDC cutter on the bit is assured to be a member of a set positioned at the same radius, but the majority of the included cutters do belong to a set. FIG. 2 shows a cutter layout diagram for an exemplary implementation of the plural set method to position cutters on a bit with six blades 30. In one plural set pattern, as shown in FIG. 2, the cutters 20 are distributed across the bit face such that the cutters in each set 22 (at the same radius 34) are located on adjacent blades 30. In an alternative plural set pattern, not shown in FIG. 2, the cutters 20 are distributed across the bit face such that the cutters in each set 32 (at the same radius 34) are located example, on non-adjacent blades 30 (for example, blades located on the radially opposite side of the bit).

Reference is now made to FIG. 3. Attempts have been made to improve shoulder durability of drill bits through the use of a plural set pattern using backup cutters. In this method, PDC cutters 20 are deployed in sets 32 containing two or more cutters each, wherein the cutters of a given set are positioned at a same radial distance 34 from the bit axis. However, unlike the configuration of FIG. 2 where the cutters 20 of a set 32 are provided on different blades 30, the cutters 20 of a set 32 in FIG. 3 are provided on the same blade 30. The leading cutter in the set 32 is referred to as a "primary" cutter (P) (provided, for example, on a primary row of cutters), and the trailing cutter in the set 32 is referred to as the "backup" cutter (B) (provided, for example, on a backup row of cutters). The included primary cutters P are typically set using the single set method described above and illustrated in FIG. 1. Because of the reduced area near the center of the bit face not every PDC cutter on the bit is assured to be a member of a set positioned at the same radius, but the majority of the included cutters do belong to a set. FIG. 3 shows a cutter layout diagram for an exemplary implementation of the plural set method with backup cutters to position cutters on a bit with six blades 30. This cutter configuration is designed increase diamond volume while improving primary cutting structure life. The trailing backup cutters B do not function during drilling operations to destroy rock or change the work of the primary cutters P (unless the primary cutter wears in use or the backup cutter has an exposure placed on or near the bit profile defined by the primary cutters).

While the foregoing prior art patterns and methods for setting the locations of PDC cutters provide drill bits with satisfactory performance, it is nonetheless recognized that there is room for improvement, especially in connection with providing a drill bit having better shoulder cutting ability. The present invention proposes a pattern and method for setting the locations of PDC cutters in a drill bit that provides for improved shoulder durability.

SUMMARY

In an embodiment, a PDC bit comprises: a plurality of blades comprising a first blade of the plurality of blades including first primary PDC cutters set in a first primary cutter row and first backup PDC cutters set in a first secondary cutter row, and wherein a radial position of each first backup PDC cutter in the first secondary cutter row is offset from a radial position of each first primary PDC cutter in the first primary cutter row.

The first backup PDC cutters may then be radially positioned between first primary PDC cutters in the first primary cutter row.

The first blade of the plurality of blades further includes first additional backup PDC cutters set in a first tertiary cutter row of the first blade of the plurality of blades. A radial position of each first additional backup PDC cutter in the first tertiary cutter row is offset from the radial positions of each first primary PDC cutter in the first primary cutter row and each first backup PDC cutter in the first secondary cutter row.

The first additional backup PDC cutters may then be radially positioned between first primary PDC cutters in the first primary cutter row.

The plurality of blades may further comprise a second blade including second primary PDC cutters set in a second primary cutter row and second backup PDC cutters set in a second secondary cutter row. A radial position of each second backup PDC cutter in the second secondary cutter row is offset from a radial position of each second primary PDC cutter in the second primary cutter row.

The second backup PDC cutters may then be radially positioned between second primary PDC cutters in the second primary cutter row.

The second blade of the plurality of blades further includes second additional backup PDC cutters set in a second tertiary cutter row of the second blade of the plurality of blades. A radial position of each second additional backup PDC cutter in the second tertiary cutter row is offset from the radial positions of each second primary PDC cutter in the second primary cutter row and each second backup PDC cutter in the second secondary cutter row.

The second additional backup PDC cutters may then be radially positioned between second primary PDC cutters in the second primary cutter row.

BRIEF DESCRIPTION OF THE DRAWINGS

A more complete understanding of the present invention may be obtained by reference to the following description in view of the accompanying drawings wherein.

DETAILED DESCRIPTION OF THE DRAWINGS

In an attempt to further improve shoulder durability of the drill bit it is proposed to use a setting pattern with backup cutters radially offset from primary cutters. In accordance with this cutter layout, the backup cutters are positioned between leading primary cutters thus making the backup cutters active cutting elements regardless of primary cutter wear. The cutter layout produces a cutting structure for the drill bit that uses all of the cutting elements from the first engagement with the formation resulting in a drill bit with more diamond on bottom.

Figure 4:
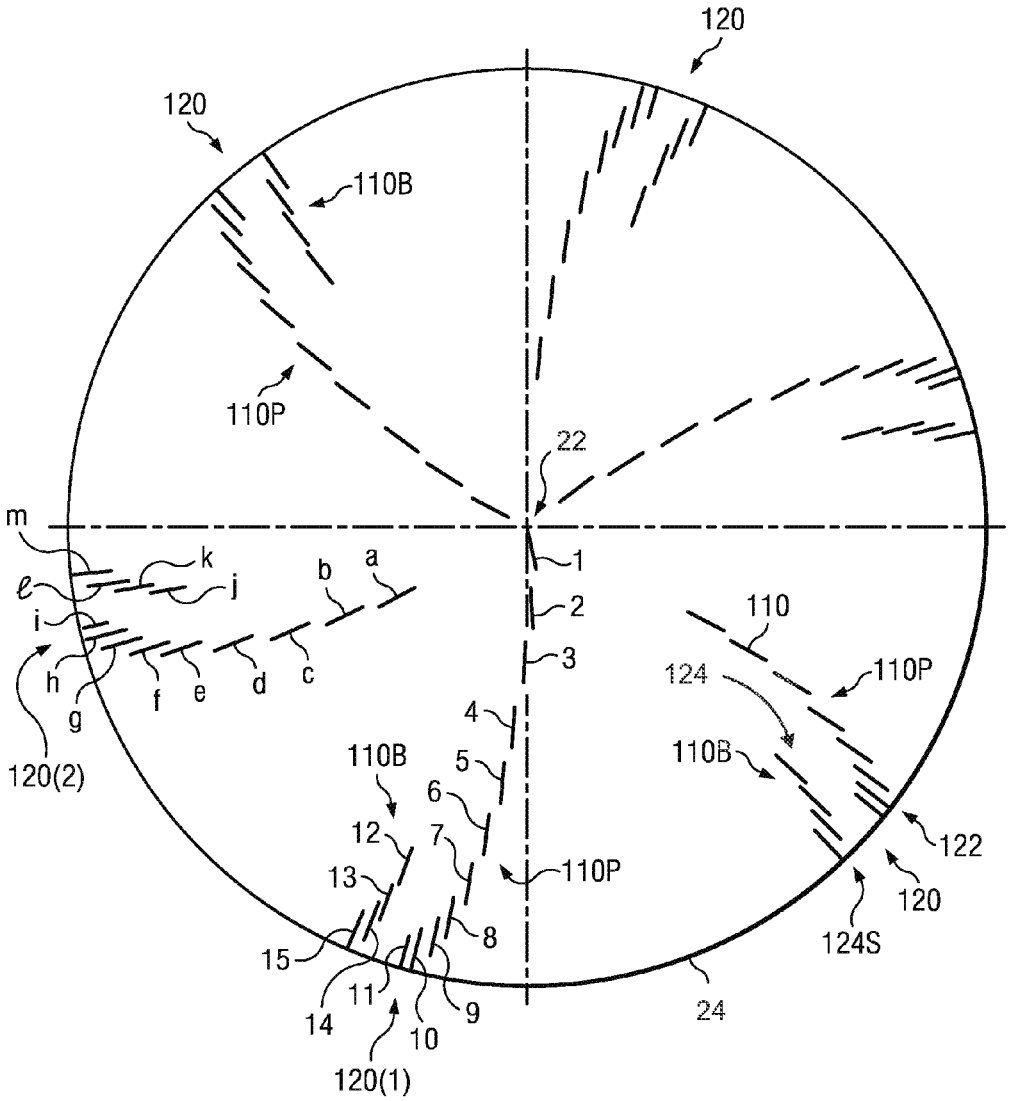
FIG. 4 is a cutter layout diagram for an exemplary six-blade bit having cutters positioned in a setting configuration using secondary backup cutters offset from the primary cutters.
Figure 5:
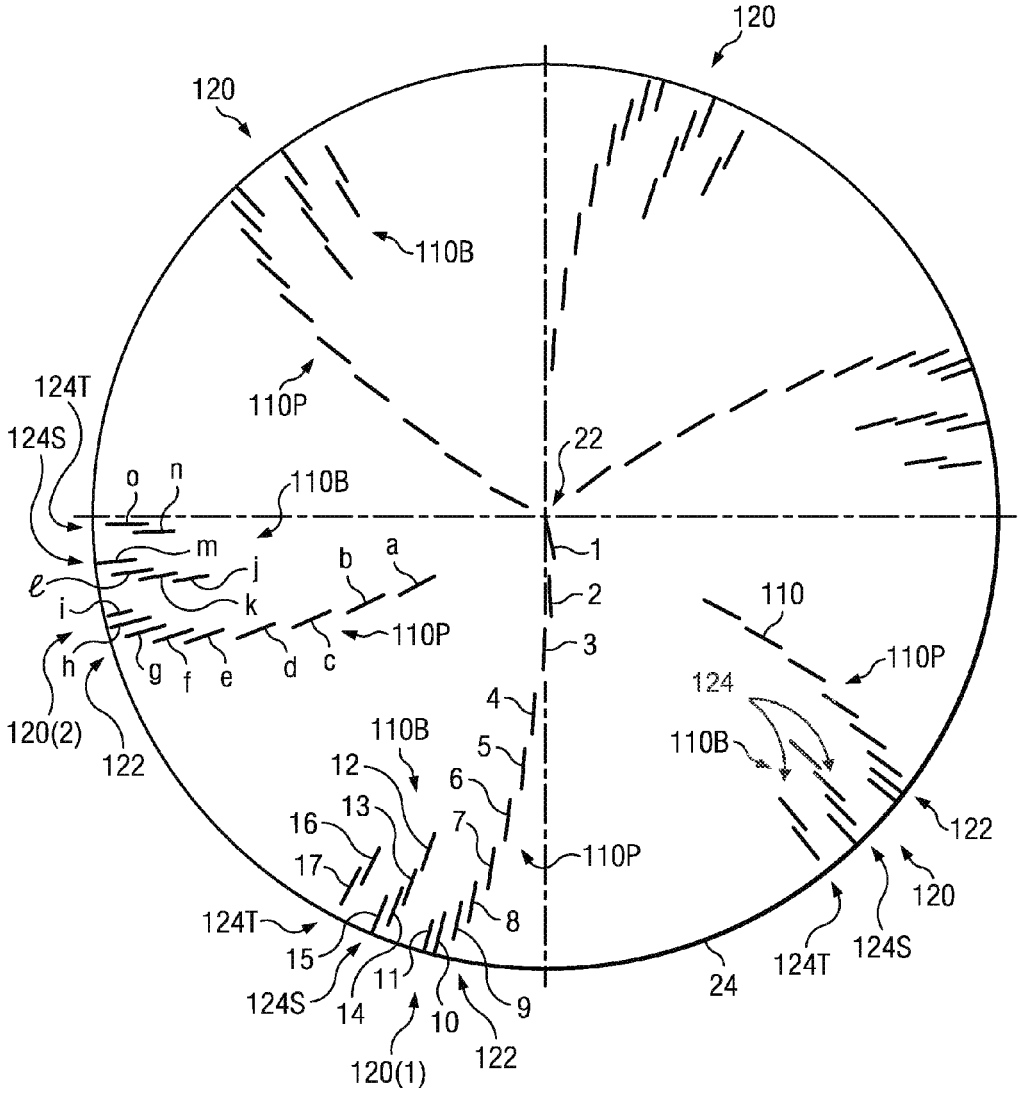
FIG. 5 is a cutter layout diagram for an exemplary six-blade bit having cutters positioned in a setting configuration using secondary and tertiary backup cutters offset from the primary cutters.

Reference is now made to FIGS. 4 and 5 which illustrate a cutter layout diagram for an exemplary six-blade bit having cutters positioned in a setting configuration using backup cutters offset from the primary cutters. Each blade 120 of the drill bit includes a group of PDC cutters 110 comprising primary cutters 110P and backup cutters 110B. The primary cutters 110P are provided in a primary cutter row 122. The backup cutters 110B are provided in one or more backup cutter rows 124 trailing the primary cutter row 122 on the same blade 120. A first backup cutter row 124 on the blade 120 (positioned adjacent the primary cutter row 122) is referred to as the "secondary" row 124S. FIG. 4 illustrates the cutter layout with a primary cutter row 122 and a secondary cutter row 124S for each blade 120. A second backup cutter row 124 on the blade 120 (positioned adjacent the secondary cutter row 124S), if included, is referred to as the "tertiary" cutter row 124T. FIG. 5 illustrates the cutter layout with a primary cutter row 122, a secondary cutter row 124S and a tertiary cutter row 124T for each blade 120. As a practical matter, no more than two backup cutter rows 124 are typically provided on the blade 120, but it will be understood that more than two backup cutter rows 124 on a given blade 120 could be provided if desired. It will additionally be understood that it is not a requirement for each blade to include a secondary cutter row 124S or tertiary cutter row 124T.

Figure 1:
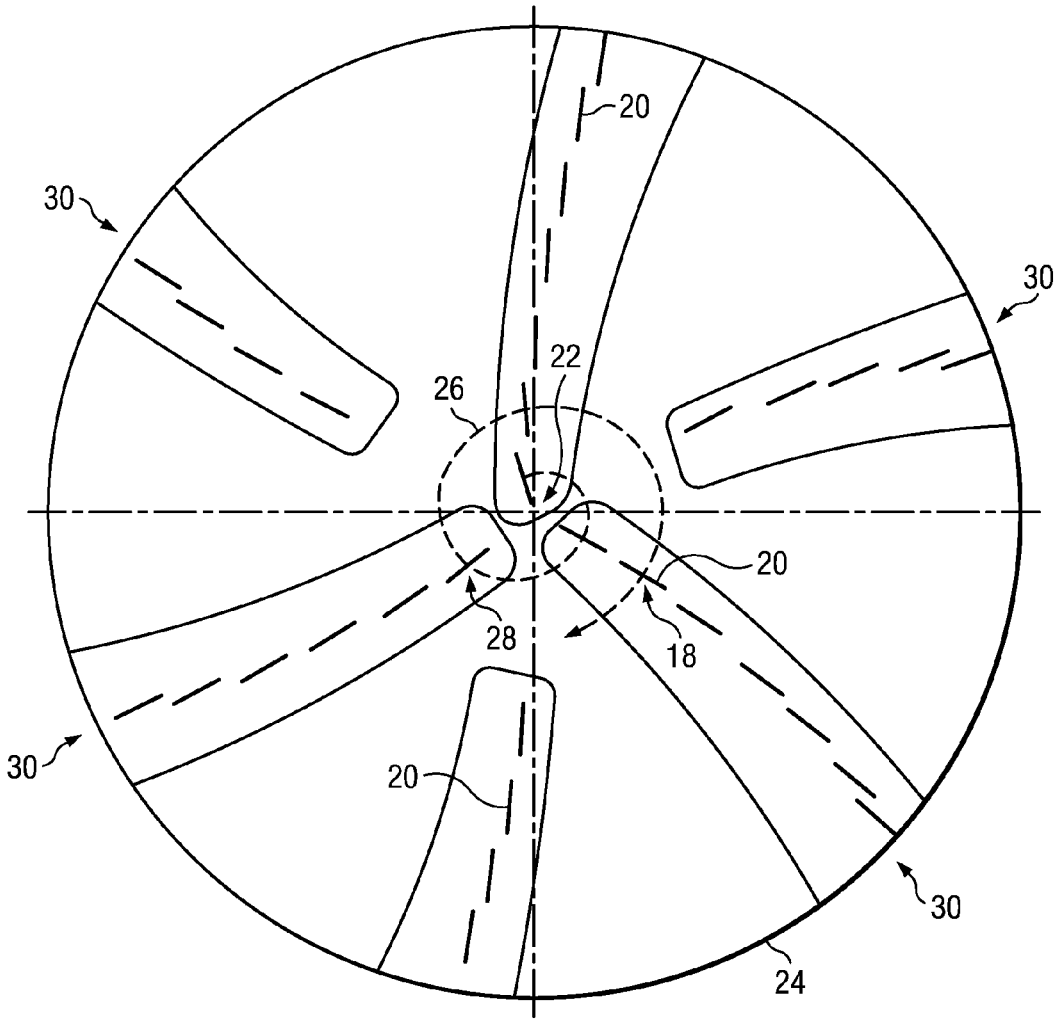
FIG. 1 (PRIOR ART)
FIG. 1 is a cutter layout diagram for an exemplary six-blade bit having cutters positioned in a "single set" configuration.
Figure 2:
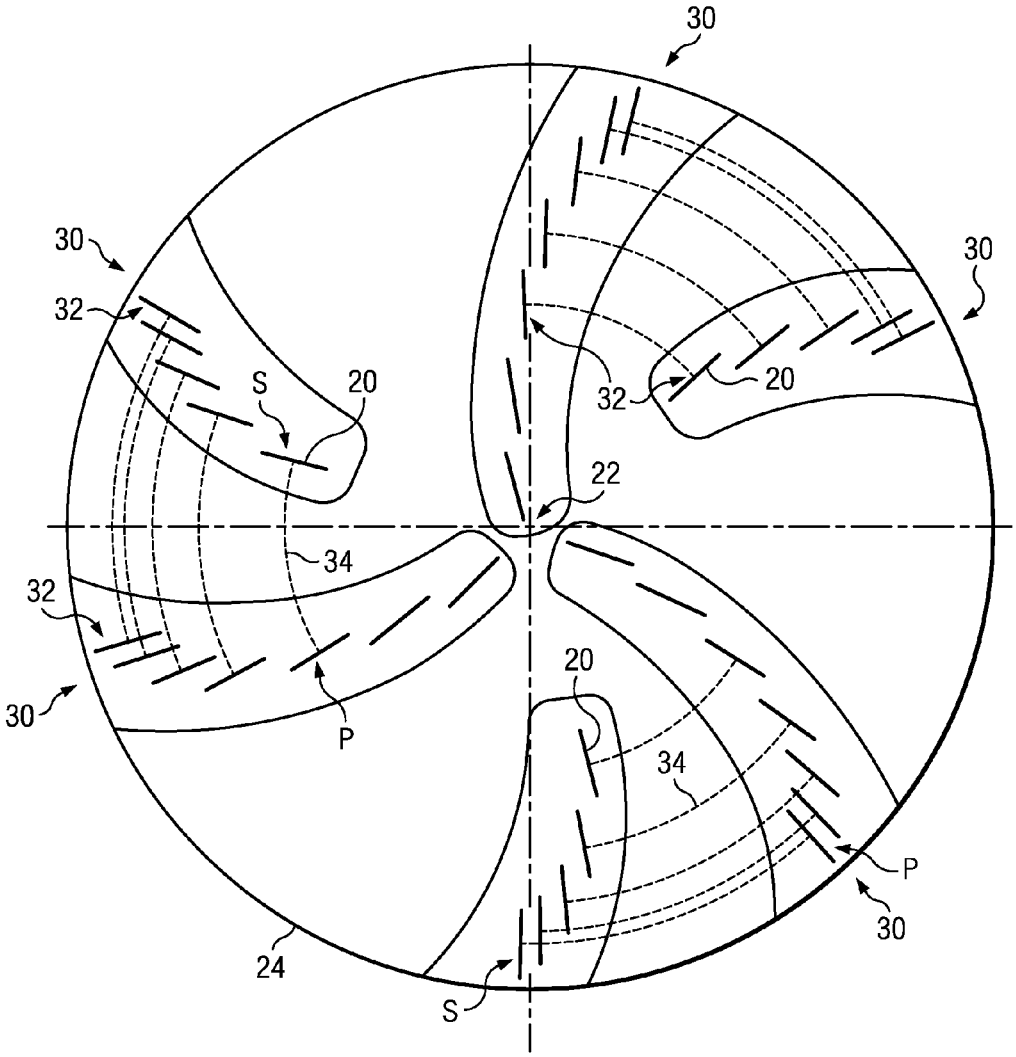
FIG. 2 (PRIOR ART)
FIG. 2 is a cutter layout diagram for an exemplary six-blade bit having cutters positioned in a "plural set" configuration.
Figure 3:
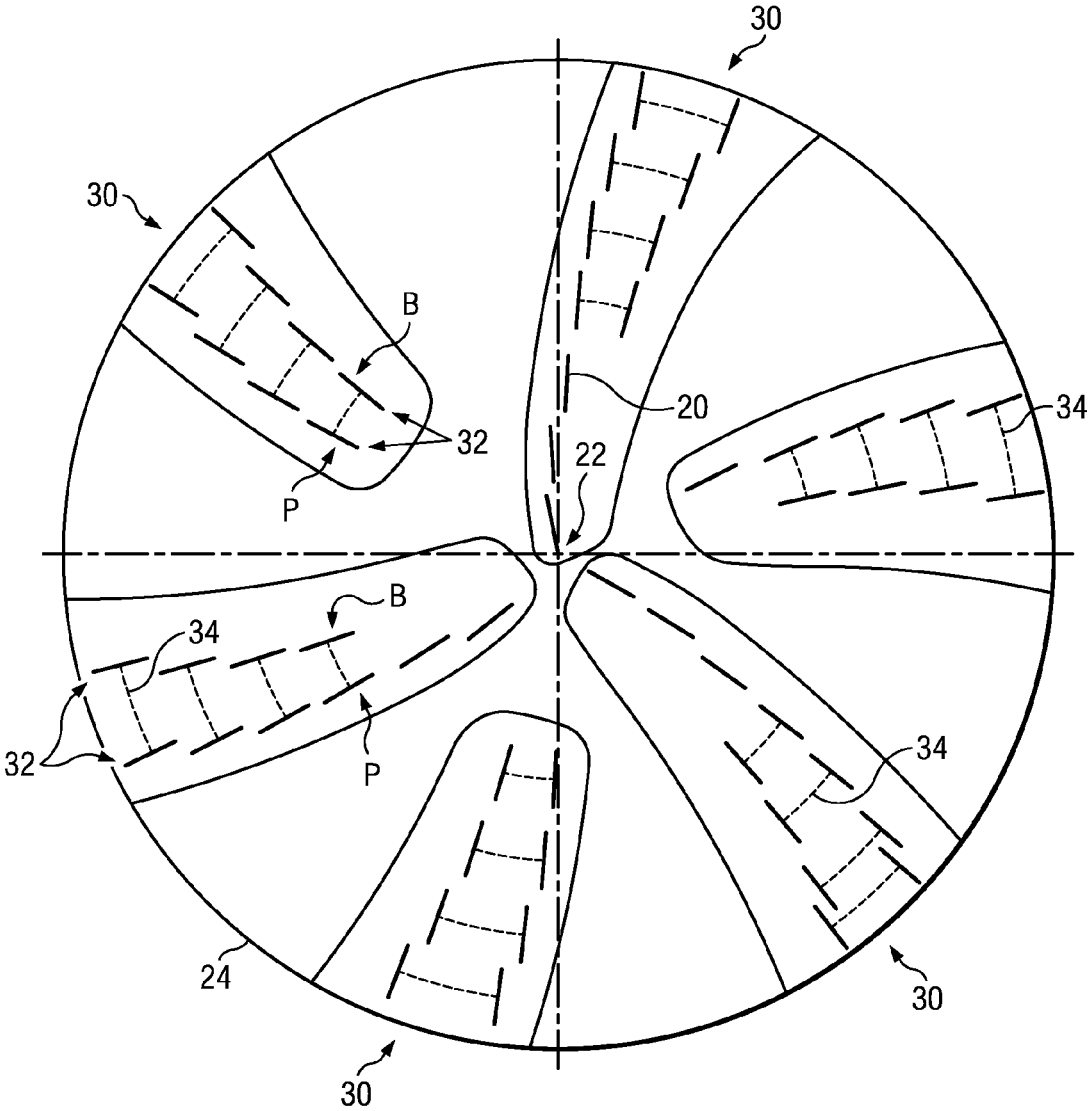
FIG. 3 (PRIOR ART)
FIG. 3 is a cutter layout diagram for an exemplary six-blade bit having cutters positioned in a plural set configuration using backup cutters.

In a preferred embodiment, the primary cutters 110P of a blade 120 are set using the single set method described above and illustrated in FIG. 1. The backup cutters 110B associated with the primary cutters 110P on a same blade 120 are preferably set so that none of the backup cutters 110B have a same radial position as the primary cutters 110P. In other words, the backup cutters 110B on a given blade 120 are radially offset from the primary cutters 110P for that given blade 120 so as to be positioned between primary cutter 110P.

In a preferred implementation, the designer of the bit selects the offset locations for the backup cutters 110B. This selection is made by the designer based at least in part on the anticipated application of bit (for example, considering the details and characteristics of the formation to be drilled). Operation of the drill bit, with the positioned primary cutters 110P and backup cutters 110B, is then simulated using a computer simulation tool. Such tools are well known to those skilled in the art. One of the outputs of such simulation tools is total cutter wear across the bit. The total cutter wear output value is affected by the offset locations for the backup cutters 110B. To the extent the simulation tool output indicates an unacceptable total cutter wear output value, the designer will select new offset locations for the backup cutters 110B and re-run the simulation. Alternatively, several offset locations for the backup cutters 110B are evaluated through use of the simulation tool. Once an acceptable set of offset locations for the backup cutters 110B has been determined, cutter placement is fixed and the bit is produced. Although total cutter wear is one preferred metric for driving the selection of offset locations for the backup cutters 110B, it will be understood that other metrics may be evaluated is considering offset locations for the backup cutters 110B.

In FIG. 4, a first blade 120(1) includes cutters 110 numbered 1-15, which include primary cutters 110P numbered 1-11 (on the primary cutter row 122) and backup cutters 110B numbered 12-15 (on the secondary cutter row 124S). The following Table is a cutter layout table showing the radial position of the cutters 110 (both primary cutters 110P on the primary cutter row 122 and backup cutters 110B on the secondary cutter row 124S) for the first blade 120(1) of a drill bit in accordance with the cutter layout diagram of FIG. 4, wherein the radial position is measured from the bit axis 22 towards the gage 24 either directly or along the bit profile in a manner well known to those skilled in the art.

| Cutter Number | Blade | Row | Radius |
|---|---|---|---|
| 1 | 120(1) | 122 | 6.847 |
| 2 | 120(1) | 122 | 26.410 |
| 3 | 120(1) | 122 | 44.017 |
| 4 | 120(1) | 122 | 67.003 |
| 5 | 120(1) | 122 | 88.262 |
| 6 | 120(1) | 122 | 108.822 |
| 7 | 120(1) | 122 | 127.111 |
| 8 | 120(1) | 122 | 141.531 |
| 9 | 120(1) | 122 | 151.217 |
| 10 | 120(1) | 122 | 155.425 |
| 11 | 120(1) | 122 | 156.575 |
| 12 | 120(1) | 124S | 128.003 |
| 13 | 120(1) | 124S | 141.681 |
| 14 | 120(1) | 124S | 150.999 |
| 15 | 120(1) | 124S | 154.877 |

Figure 6:
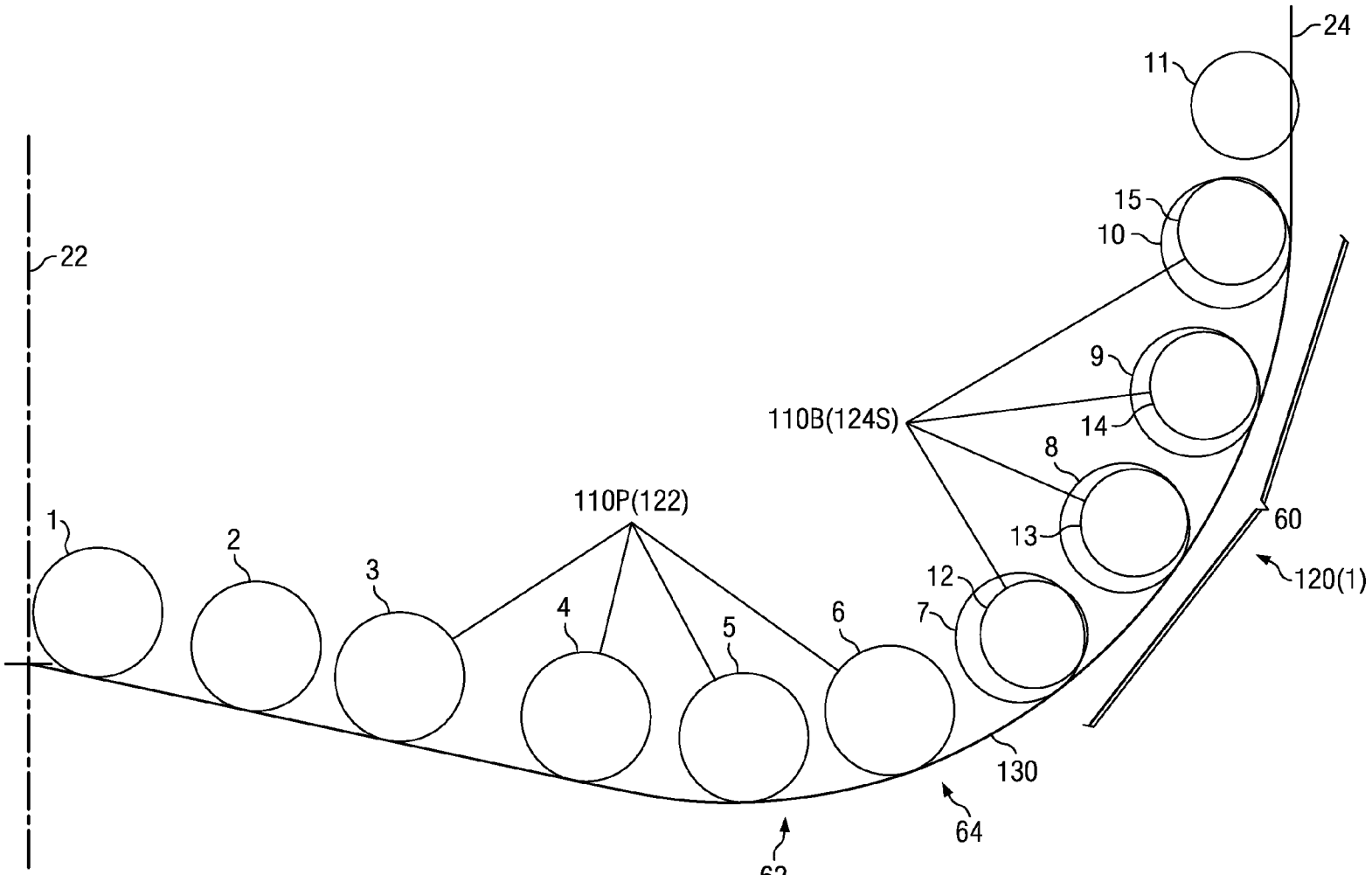
FIG. 6 illustrates the bit profile for a first blade of the cutter layout shown in FIG. 4.

FIG. 6 illustrates the bit profile for the first blade 120(1) of the cutter layout shown in FIG. 4 and defined by the foregoing Table. The backup cutters 110B numbered 12-15 (on the secondary cutter row 124S) are shown to be positioned in a shoulder portion 60 of the bit adjacent the bit gage 24 (and outside of the bit nose 62 and taper 64 regions) and furthermore are radially offset from the primary cutters 110P numbered 1-11 (on the primary cutter row 122). Furthermore, the backup cutters 110B numbered 12-15 (on the secondary cutter row 124S) preferably have a same cutter shape (in this case, circular) and smaller cutter profile (in this case, cutter diameter) than the primary cutters 110P numbered 1-11 (on the primary cutter row 122). It will, however, be understood that the backup cutters 110B could, in an alternate implementation, have a same cutter profile (for example, same diameter) as the primary cutters 110P. Furthermore, it will be understood that the backup cutters 110B could, in an alternate implementation, have a different cutter shape (for example, oval) than the primary cutters 110P. The backup cutters 110B numbered 12-15 (on the secondary cutter row 124S) preferably have a different exposure than the primary cutters 110P numbered 1-11 (i.e., they are offset from the bit profile line 130). It will, however, be understood that the backup cutters 110B could, in an alternate implementation, have a same exposure as the primary cutters 110P.

In FIG. 5, a first blade 120(1) includes cutters 110 numbered 1-17, which include primary cutters 110P numbered 1-11 and backup cutters 110B numbered 12-17 (with cutters numbered 12-15 on the secondary cutter row 124S and cutters numbered 16-17 on the tertiary cutter row 124T). The following Table is a cutter layout table showing the radial position of the cutters 110 (both primary cutters 110P and backup cutters 110B of the secondary cutter row 124S and tertiary cutter row 124T) for the first blade 120(1) of a drill bit in accordance with the cutter layout diagram of FIG. 5, wherein the radial position is measured from the bit axis 22 towards the gage 24 along the bit profile in a manner well known to those skilled in the art.

| Cutter Number | Blade | Row | Radius |
|---|---|---|---|
| 1 | 120(1) | 122 | 6.847 |
| 2 | 120(1) | 122 | 26.410 |
| 3 | 120(1) | 122 | 44.017 |
| 4 | 120(1) | 122 | 67.003 |
| 5 | 120(1) | 122 | 88.262 |
| 6 | 120(1) | 122 | 108.822 |
| 7 | 120(1) | 122 | 127.111 |
| 8 | 120(1) | 122 | 141.531 |

-continued

| Cutter Number | Blade | Row | Radius |
|---|---|---|---|
| 9 | 120(1) | 122 | 151.217 |
| 10 | 120(1) | 122 | 155.425 |
| 11 | 120(1) | 122 | 156.575 |
| 12 | 120(1) | 124S | 128.003 |
| 13 | 120(1) | 124S | 141.681 |
| 14 | 120(1) | 124S | 150.999 |
| 15 | 120(1) | 124S | 154.877 |
| 16 | 120(1) | 124T | 142.334 |
| 17 | 120(1) | 124T | 151.362 |

Figure 7:
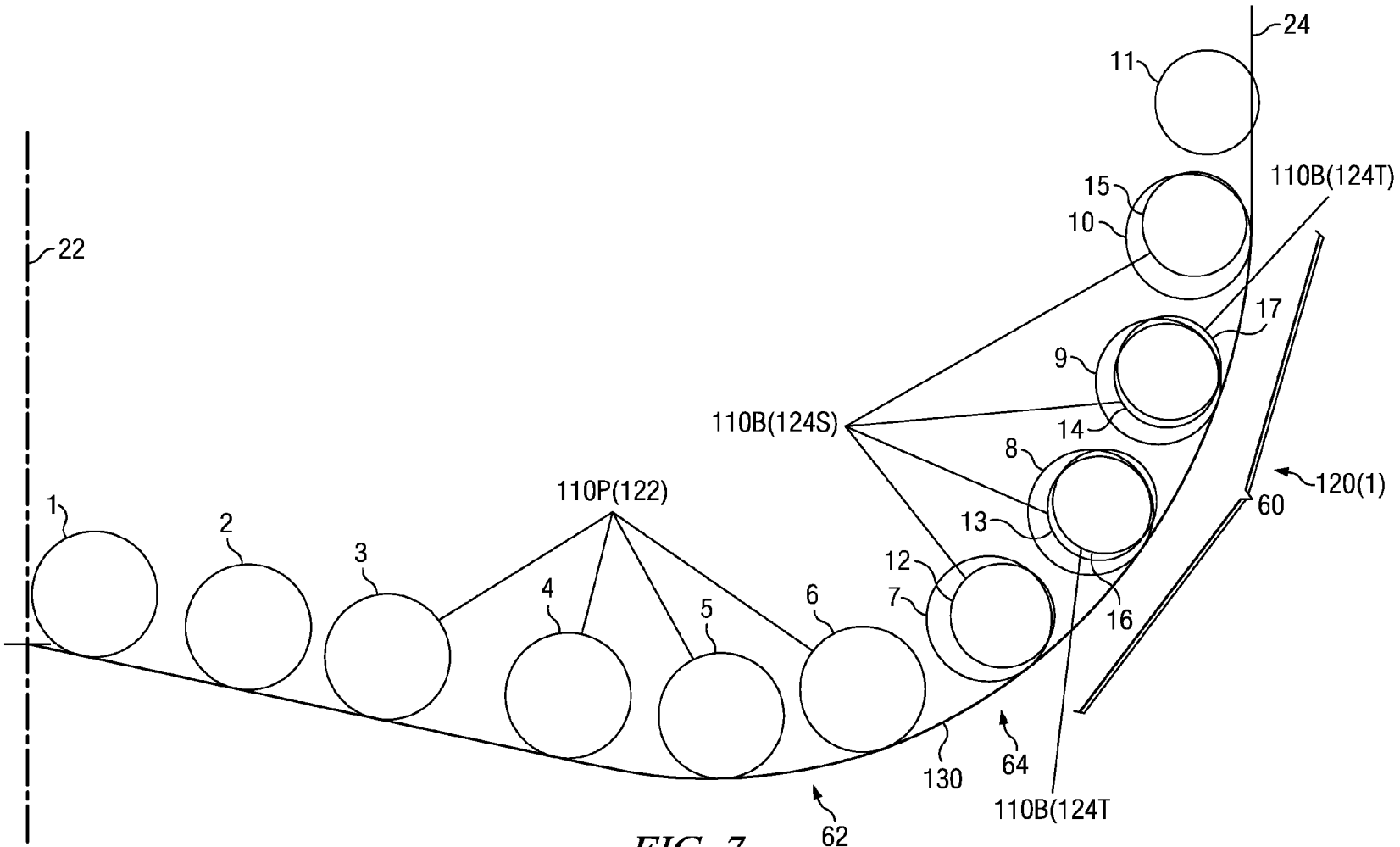
FIG. 7 illustrates the bit profile for a first blade of the cutter layout shown in FIG. 5.

FIG. 7 illustrates the bit profile for the first blade 120(1) of the cutter layout shown in FIG. 5 and defined by the foregoing Table. The backup cutters 110B numbered 12-17 (on the secondary cutter row 124S and tertiary cutter row 124T) are shown to be positioned in a shoulder portion 60 of the bit adjacent the bit gage 24 (and outside of the bit nose 62 and taper 64 regions) and furthermore are radially offset from the primary cutters 110P numbered 1-11 (on the primary cutter row 122). Also, the backup cutters 110B numbered 16-17 (on the tertiary cutter row 124T) are shown to be radially offset from the backup cutters 110B numbered 12-15 (on the secondary cutter row 124S). Furthermore, the backup cutters 110B numbered 12-17 (on the secondary cutter row 124S and tertiary cutter row 124T) preferably have a same cutter shape (in this case, circular) and smaller cutter profile (in this case, cutter diameter) than the primary cutters 110P numbered 1-11 (on the primary cutter row 122). It will, however, be understood that the backup cutters 110B could, in an alternate implementation, have a same cutter profile (for example, same diameter) as the primary cutters 110P. Furthermore, it will be understood that the backup cutters 110B could, in an alternate implementation, have a different cutter shape (for example, oval) than the primary cutters 110P. The backup cutters 110B numbered 12-17 (on the secondary cutter row 124S and tertiary cutter row 124T) preferably have a different exposure than the primary cutters 110P numbered 1-11 (i.e., they are offset from the bit profile line 130). It will, however, be understood that the backup cutters 110B could, in an alternate implementation, have a same exposure as the primary cutters 110P.

In FIG. 4, a second blade 120(2) includes cutters 110 lettered a-m, which include primary cutters 110P lettered a-i and backup cutters 110B lettered j-m (on the secondary cutter row 124S). The following Table is a cutter layout table showing the radial position of the cutters 110 (both primary cutters 110P and backup cutters 110B of the secondary cutter row 124S) for the second blade 120(2) of a drill bit in accordance with the cutter layout diagram of FIG. 4, wherein the radial position is measured from the bit axis 22 towards the gage 24 along the bit profile in a manner well known to those skilled in the art.

| Cutter Number | Blade | Row | Radius |
|---|---|---|---|
| a | 120(2) | 122 | 47.929 |
| b | 120(2) | 122 | 70.671 |
| c | 120(2) | 122 | 91.757 |
| d | 120(2) | 122 | 112.083 |
| e | 120(2) | 122 | 129.802 |
| f | 120(2) | 122 | 143.499 |
| g | 120(2) | 122 | 152.313 |
| h | 120(2) | 122 | 155.565 |
| i | 120(2) | 122 | 156.575 |
| j | 120(2) | 124S | 130.619 |

-continued

| Cutter Number | Blade | Row | Radius |
|---|---|---|---|
| k | 120(2) | 124S | 143.588 |
| l | 120(2) | 124S | 152.034 |
| m | 120(2) | 124S | 154.930 |

Figure 8:
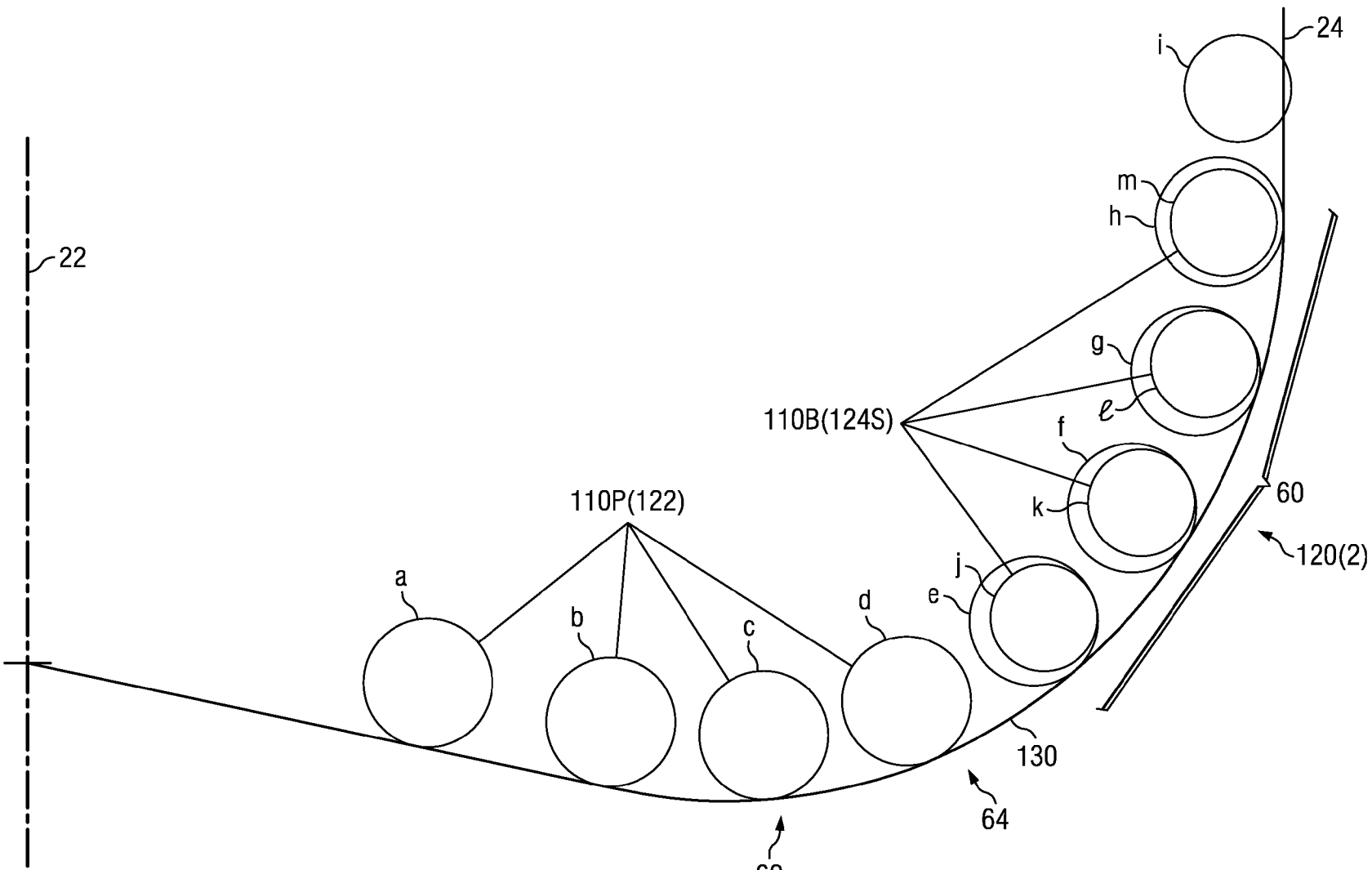
FIG. 8 illustrates the bit profile for a second blade of the cutter layout shown in FIG. 4.

FIG. 8 illustrates the bit profile for the second blade 120(2) of the cutter layout shown in FIG. 4 and defined by the foregoing Table. The backup cutters 110B lettered j-m (on the secondary cutter row 124S) are shown to be positioned in a shoulder portion 60 of the bit adjacent the bit gage 24 (and outside of the bit nose 62 and taper 64 regions) and furthermore are radially offset from the primary cutters 110P lettered a-i (on the primary cutter row 122). Furthermore, the backup cutters 110B lettered j-m (on the secondary cutter row 124S) preferably have a same cutter shape (in this case, circular) and smaller cutter profile (in this case, cutter diameter) than the primary cutters 110P lettered a-i (on the primary cutter row 122). It will, however, be understood that the backup cutters 110B could, in an alternate implementation, have a same cutter profile (for example, same diameter) as the primary cutters 110P. Furthermore, it will be understood that the backup cutters 110B could, in an alternate implementation, have a different cutter shape (for example, oval) than the primary cutters 110P. The backup cutters 110B lettered j-m (on the secondary cutter row 124S) preferably have a different exposure than the primary cutters 110P lettered a-i (i.e., they are offset from the bit profile line 130). It will, however, be understood that the backup cutters 110B could, in an alternate implementation, have a same exposure as the primary cutters 110P.

In FIG. 5, a second blade 120(2) includes cutters 110 lettered a-o, which include primary cutters 110P lettered a-i and backup cutters 110B lettered j-o (with cutters lettered j-m on the secondary cutter row 124S and cutters lettered n-o on the tertiary cutter row 124T). The following Table is a cutter layout table showing the radial position of the cutters 110 (both primary cutters 110P and backup cutters 110B of the secondary cutter row 124S and tertiary cutter row 124T) for the second blade 120(2) of a drill bit in accordance with the cutter layout diagram of FIG. 5, wherein the radial position is measured from the bit axis 22 towards the gage 24 along the bit profile in a manner well known to those skilled in the art.

| Cutter Number | Blade | Row | Radius |
|---|---|---|---|
| a | 120(2) | 122 | 47.929 |
| b | 120(2) | 122 | 70.671 |
| c | 120(2) | 122 | 91.757 |
| d | 120(2) | 122 | 112.083 |
| e | 120(2) | 122 | 129.802 |
| f | 120(2) | 122 | 143.499 |
| g | 120(2) | 122 | 152.313 |
| h | 120(2) | 122 | 155.565 |
| i | 120(2) | 122 | 156.575 |
| j | 120(2) | 124S | 130.619 |
| k | 120(2) | 124S | 143.588 |
| l | 120(2) | 124S | 152.034 |
| m | 120(2) | 124S | 154.930 |
| n | 120(2) | 124T | 144.195 |
| o | 120(2) | 124T | 152.346 |

Figure 9:
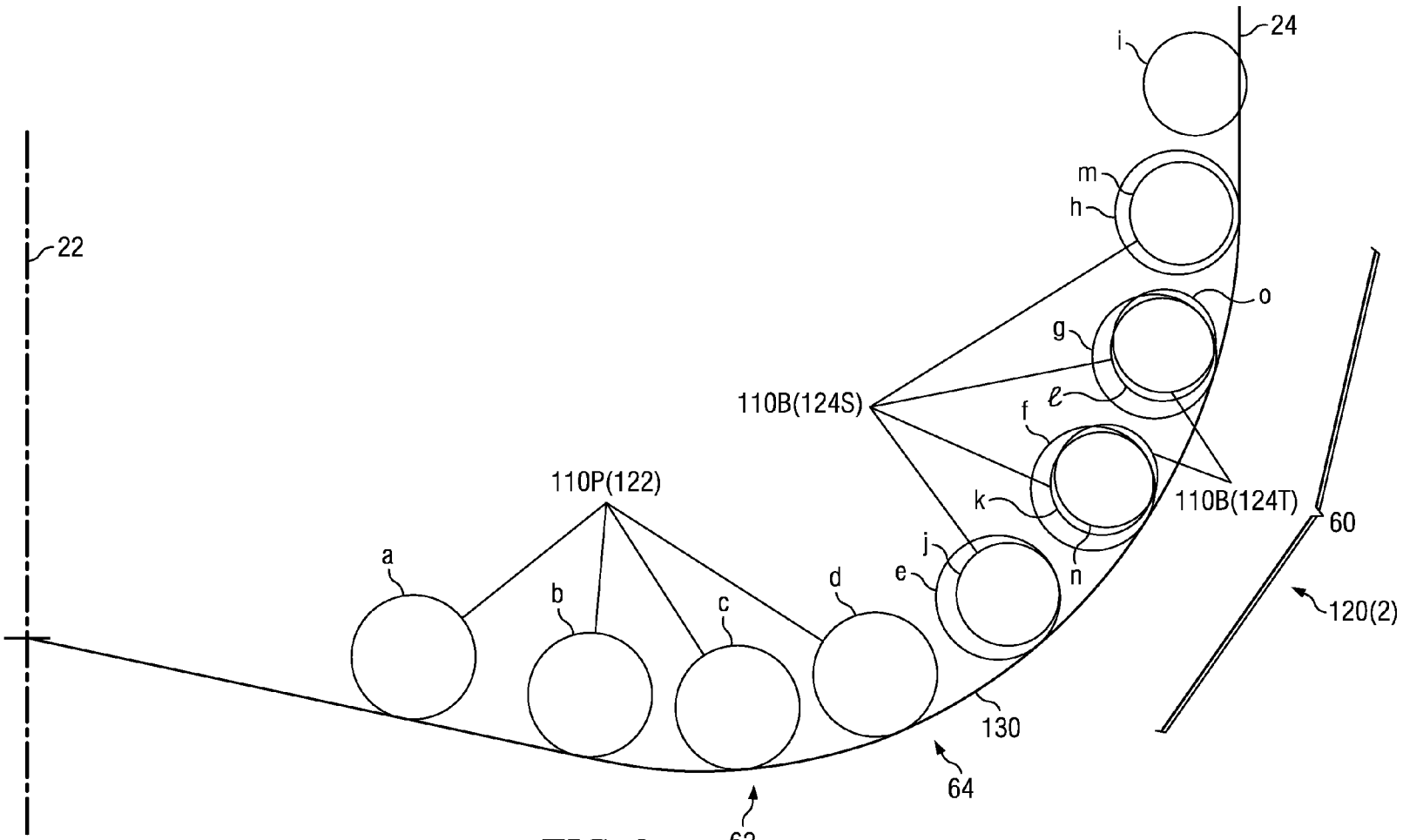
FIG. 9 illustrates the bit profile for a second blade of the cutter layout shown in FIG. 5.

FIG. 9 illustrates the bit profile for the second blade 120(2) of the cutter layout shown in FIG. 5 and defined by the foregoing Table. The backup cutters 110B lettered j-o (on the secondary cutter row 124S and tertiary cutter row 124T) are shown to be positioned in a shoulder portion 60 of the bit adjacent the bit gage 24 (and outside of the bit nose 62 and taper 64 regions) and furthermore are radially offset from the primary cutters 110P lettered a-i (on the primary cutter row 122). Also, the backup cutters 110B lettered n-o (on the tertiary cutter row 124T) are shown to be radially offset from the backup cutters 110B lettered j-m (on the secondary cutter row 124S). Furthermore, the backup cutters 110B lettered j-o (on the secondary cutter row 124S and tertiary cutter row 124T) preferably have a same cutter shape (in this case, circular) and smaller cutter profile (in this case, cutter diameter) than the primary cutters 110P lettered a-i (on the primary cutter row 122). It will, however, be understood that the backup cutters 110B could, in an alternate implementation, have a same cutter profile (for example, same diameter) as the primary cutters 110P. Furthermore, it will be understood that the backup cutters 110B could, in an alternate implementation, have a different cutter shape (for example, oval) than the primary cutters 110P. The backup cutters 110B lettered j-o (on the secondary cutter row 124S and tertiary cutter row 124T) preferably have a different exposure than the primary cutters 110P lettered a-i (i.e., they are offset from the bit profile line 130). It will, however, be understood that the backup cutters 110B could, in an alternate implementation, have a same exposure as the primary cutters 110P.

Figure 10:
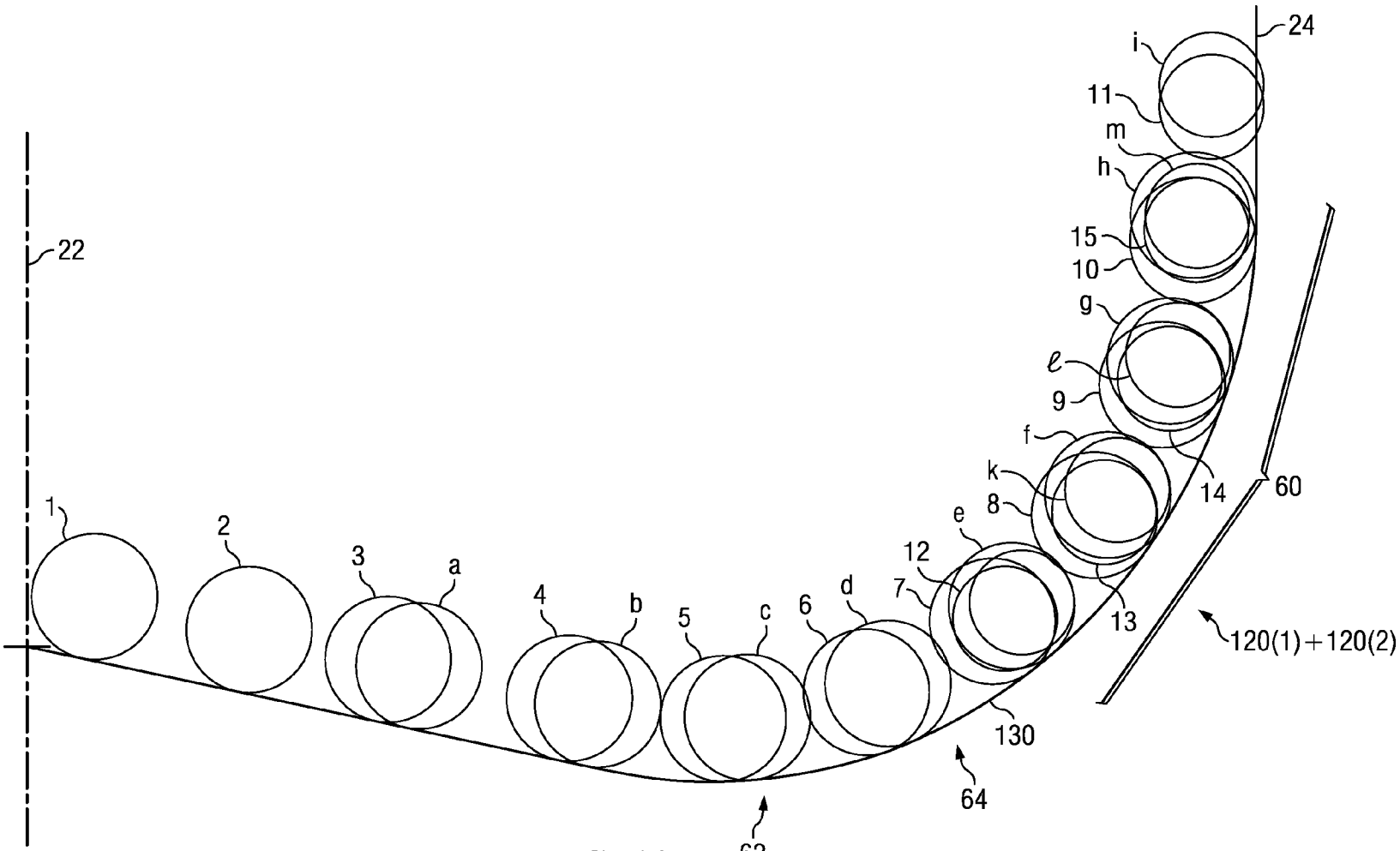
FIG. 10 illustrates an overlay of the bit profiles for the first and second blades (FIGS. 6 and 8) of the cutter layout shown in FIG. 4.

Reference is now made to FIG. 10 which illustrates an overlay of the bit profiles for the first and second blades (as shown in FIGS. 6 and 8) of the cutter layout shown in FIG. 4. The backup cutters 110B numbered 12-15 (on the secondary cutter row 124S) for the first blade 120(1) are shown to be radially offset from the primary cutters 110P numbered 1-11 (on the primary cutter row 122). The backup cutters 110B lettered j-m (on the secondary cutter row 124S) for the second blade 120(2) are shown to be radially offset from the primary cutters 110P lettered a-i (on the primary cutter row 122). Still further, the cutters 110 for the first blade 120(1) are shown to be radially offset from the cutters 110 for the second blade 120(2). Furthermore, the backup cutters 110B numbered 12-15 and lettered j-m preferably have a same cutter shape (in this case, circular) and smaller cutter profile (in this case, cutter diameter) than the primary cutters 110P numbered 1-11 and lettered a-i. It will, however, be understood that the backup cutters 110B could, in an alternate implementation, have a same cutter profile (for example, same diameter) as the primary cutters 110P. Furthermore, it will be understood that the backup cutters 110B could, in an alternate implementation, have a different cutter shape (for example, oval) than the primary cutters 110P. The backup cutters 110B numbered 12-15 and lettered j-m preferably have a different exposure than the primary cutters 110P numbered 1-11 and lettered a-i (i.e., they are offset from the bit profile line 130). It will, however, be understood that the backup cutters 110B could, in an alternate implementation, have a same exposure as the primary cutters 110P.

Figure 11:
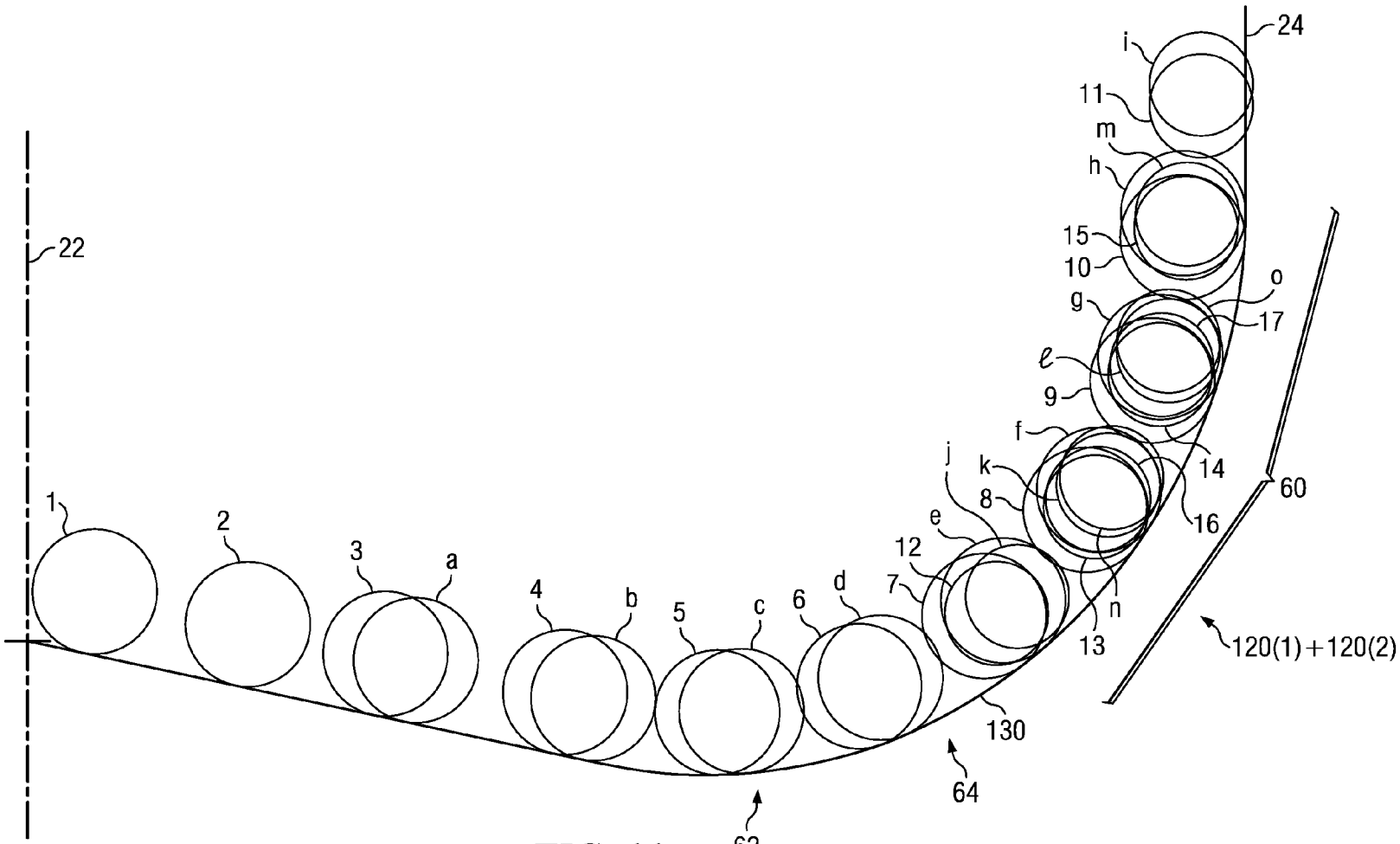
FIG. 11 illustrates an overlay of the bit profiles for the first and second blades (FIGS. 7 and 9) of the cutter layout shown in FIG. 5.

Reference is now made to FIG. 11 which illustrates an overlay of the bit profiles for the first and second blades (as shown in FIGS. 7 and 9) of the cutter layout shown in FIG. 5. The backup cutters 110B numbered 12-17 (on the secondary cutter row 124S and tertiary cutter row 124T) for the first blade 120(1) are shown to be radially offset from the primary cutters 110P numbered 1-11 (on the primary cutter row 122). The backup cutters 110B lettered j-o (on the secondary cutter row 124S and tertiary cutter row 124T) for the second blade 120(2) are shown to be radially offset from the primary cutters 110P lettered a-i (on the primary cutter row 122). Still further, the cutters 110 for the first blade 120(1) are shown to be radially offset from the cutters 110 for the second blade

120(2). Furthermore, the backup cutters 110B numbered 12-17 and lettered j-o preferably have a same cutter shape (in this case, circular) and smaller cutter profile (in this case, cutter diameter) than the primary cutters 110P numbered 1-11 and lettered a-i. It will, however, be understood that the backup cutters 110B could, in an alternate implementation, have a same cutter profile (for example, same diameter) as the primary cutters 110P. Furthermore, it will be understood that the backup cutters 110B could, in an alternate implementation, have a different cutter shape (for example, oval) than the primary cutters 110P. The backup cutters 110B numbered 12-15 and lettered j-o preferably have a different exposure than the primary cutters 110P numbered 1-11 and lettered a-i (i.e., they are offset from the bit profile line 130). It will, however, be understood that the backup cutters 110B could, in an alternate implementation, have a same exposure as the primary cutters 110P.

Figure 12:
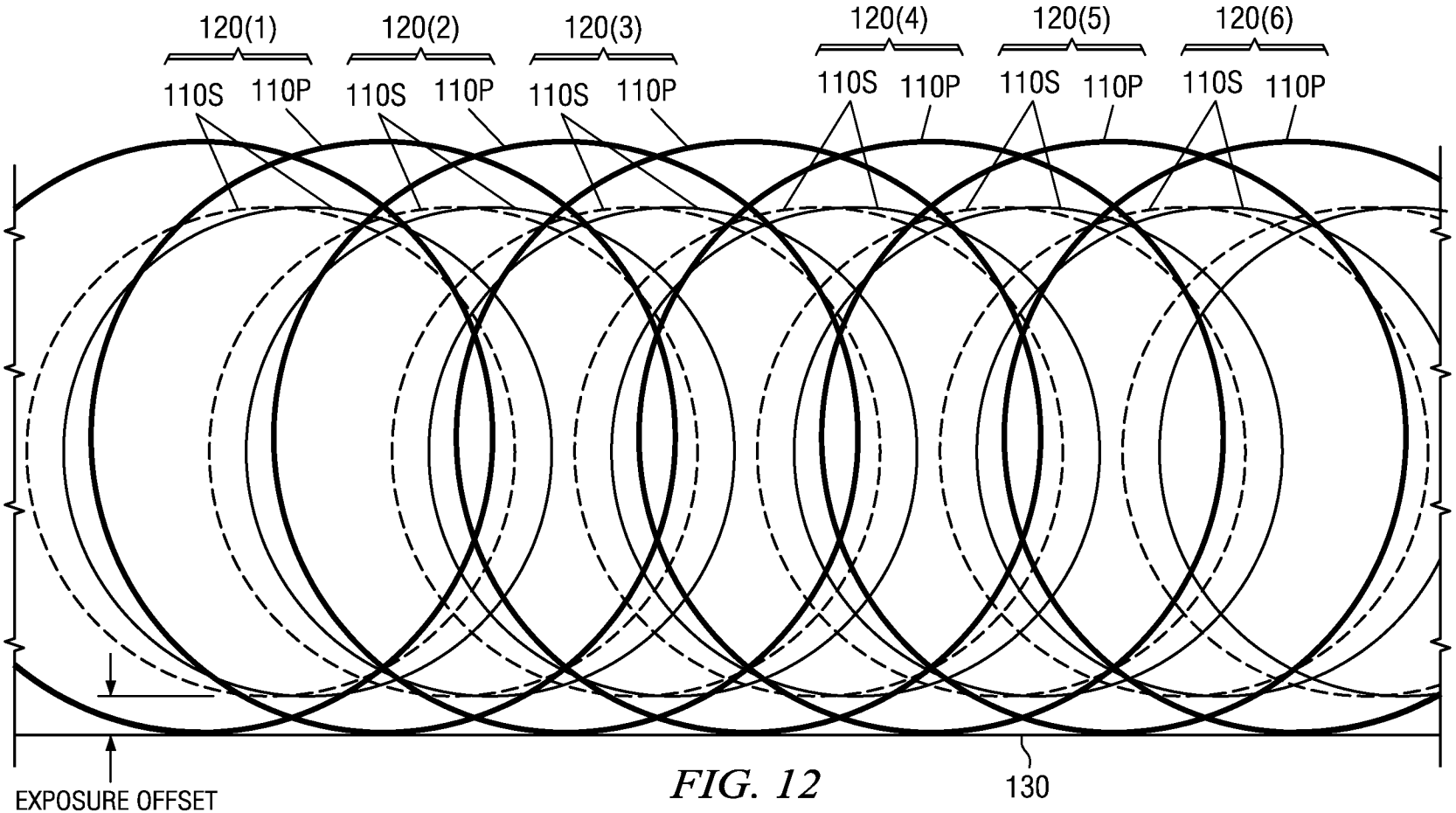
FIG. 12 illustrates a partial bit profile showing cutter placement for six blades in accordance with a setting configuration using secondary backup cutters offset from the primary cutters.

The illustration of FIGS. 10 and 11 shows cutters relating to only two of the six blades 120 of the drill bit illustrated in FIGS. 4 and 5, respectively. FIG. 12 illustrates a partial bit profile showing cutter placement for six blades in accordance with a setting configuration using secondary backup cutters offset from the primary cutters. The thicker cutter outlines designate the primary cutters 110P for six blades 120(1)-120(6) on the primary cutter row 122. The thinner cutter outlines designate the backup cutters 110B for the same six blades 120(1)-120(6) on the secondary cutter row 124S. The dotted cutter outlines designate the backup cutters 110B for the same six blades 120(1)-120(6) on the tertiary cutter row 124T. The backup cutters 110B have a different exposure than the primary cutters 110P (i.e., they are offset from the bit profile line 130). It will, however, be understood that the backup cutters 110B could, in an alternate implementation, have a same exposure as the primary cutters 110P (the exposure offset=zero).

Figure 13:
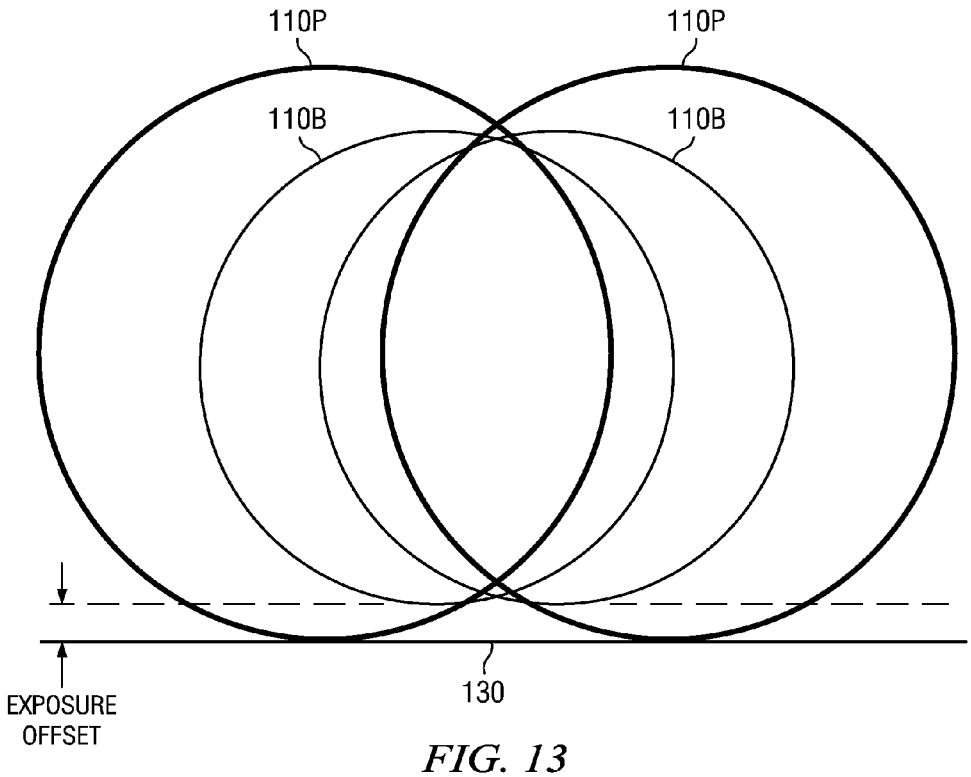
FIG. 13 is a simplified illustration of the setting configuration of FIG. 12.

FIG. 13 is a simplified illustration of the setting configuration of FIG. 12. The two illustrated primary cutters 110P are located on two different blades. The two illustrated backup cutters 11B, in one implementation, are located on the same blade as one of the two illustrated primary cutters 110P. Alternatively, one of the illustrated backup cutters 11B is located on the same blade as one of the two illustrated primary cutters 110P, and the other of the illustrated backup cutters 11B is located on the same blade as the other of the two illustrated primary cutters 110P. In any case, there is a radial offset among and between all of the cutters so that the backup cutters 11B are positioned between primary cutters 110P.

Those skilled in the art will recognize that the six-bladed configuration discussed above is just an example and that the concepts described herein are equally applicable to bits with any selected odd or even number of blades. Such configurations will be readily apparent to one skilled in the art following the foregoing examples and teachings provided herein.

It will further be understood that each included cutter may be defined to have a certain back rake and side rake configuration. In other words, there need not be a common back rake and side rake configuration for each PDC on a given blade, or each PDC cutter included in a given set. This selection is left to the bit designer who may tweak the rake configurations as needed to achieve desired goals of the bit design.

In field trials, bits with cutters set in accordance with the setting pattern described herein, have been shown to drill with an improved cost per foot (i.e., there is an increase in the footage drilled with these bits in comparison to what would be expected and what is experienced with bits not configured as shown) while providing added durability at the shoulder region (i.e., there is an improvement in the dull conditions of the bits in comparison to what would be expected and what is experienced with bits not configured as shown).

An advantage of the setting methodology described herein is that the methodology provides a bit with enhanced cutting ability at the shoulder region of the bit. This is due to having all cutters (primary and backup) in a position to engage the formation. More specifically, the setting methodology positions the backup cutters to engage the formation without relying on wear of the primary cutters. Bits set in accordance with the disclosed methodology provide more diamond on bottom than is present with the prior art cutters using conventionally set backup cutters.

Embodiments of the invention have been described and illustrated above. The invention is not limited to the disclosed embodiments. Although preferred embodiments of the method and apparatus have been illustrated and described, it will be understood that the invention is not limited to the embodiments disclosed, but is capable of numerous rearrangements, modifications and substitutions within the scope of the disclosure and as understood by those skilled in the art.

What is claimed is:

1. A PDC bit, comprising:

a plurality of blades comprising a first blade of the plurality of blades including first primary PDC cutters set in a first primary cutter row and first backup PDC cutters set in a first secondary cutter row, wherein a radial position of each first backup PDC cutter in the first secondary cutter row is offset from a radial position of each first primary PDC cutter in the first primary cutter row, and wherein at least one first primary PDC cutter only partially overlies a corresponding radially offset secondary PDC cutter such that a peripheral edge of the radially offset secondary PDC cutter is exposed outside of the at least one first primary PDC in a bit profile of said first blade.

2. The bit of claim 1, wherein the plurality of blades further comprises a second blade of the plurality of blades including second primary PDC cutters set in a second primary cutter row and second backup PDC cutters set in a second secondary cutter row, and wherein a radial position of each second backup PDC cutter in the second secondary cutter row is offset from a radial position of each second primary PDC cutter in the second primary cutter row.

3. The bit of claim 2, wherein the radial position of each first primary PDC cutter is offset from the radial position of each second primary PDC cutter.

4. The bit of claim 2, wherein the radial position of each first backup PDC cutter is offset from the radial position of each second backup PDC cutter.

5. The bit of claim 2, wherein none of the first primary PDC cutters, second primary PDC cutters, first backup PDC cutters and second backup PDC cutters share a common radial position.

6. The bit of claim 2, wherein the radial position of each second backup PDC cutter in the second secondary cutter row radially positions the second backup PDC cutters between second primary PDC cutters in the second primary cutter row.

7. The bit of claim 1, wherein the first blade of the plurality of blades further includes first additional backup PDC cutters set in a first tertiary cutter row of the first blade of the plurality of blades, and wherein a radial position of each first additional backup PDC cutter in the first tertiary cutter row is offset from the radial positions of each first primary PDC cutter in the first primary cutter row and each first backup PDC cutter in the first secondary cutter row.

8. The bit of claim 7, wherein the radial position of at least one first additional backup PDC cutter in the first tertiary cutter row of the first blade radially positions said at least one first additional backup PDC cutter of the first blade with a peripheral edge exposed between adjacent ones of the first primary PDC cutters in the first primary cutter row of the first blade.

9. The bit of claim 7, wherein the plurality of blades further comprises a second blade of the plurality of blades including second primary PDC cutters set in a second primary cutter row, second backup PDC cutters set in a second secondary cutter row and second additional backup PDC cutters set in a second tertiary cutter row, and wherein a radial position of each second backup PDC cutter in the second secondary cutter row and second additional backup PDC cutter in the tertiary cutter row is offset from a radial position of each second primary PDC cutter in the second primary cutter row.

10. The bit of claim 9, wherein the radial position of each first primary PDC cutter is offset from the radial position of each second primary PDC cutter.

11. The bit of claim 9, wherein the radial position of each first backup PDC cutter is offset from the radial position of each second backup PDC cutter.

12. The bit of claim 9, wherein the radial position of each first additional backup PDC cutter is offset from the radial position of each second additional backup PDC cutter.

13. The bit of claim 9, wherein none of the first primary PDC cutters, second primary PDC cutters, first backup PDC cutters, second backup PDC cutters, first additional backup PDC cutters and second additional backup PDC cutters share a common radial position.

14. The bit of claim 9, wherein the radial position of at least one second additional backup PDC cutter in the second tertiary cutter row of the second blade radially positions said at least one second additional backup PDC cutter of the first blade with a peripheral edge exposed between adjacent ones of the second primary PDC cutters in the second primary cutter row of the second blade.

15. The bit of claim 1, wherein the first backup PDC cutters set in a first secondary cutter row are set at radial positions placing the first backup PDC cutters in a shoulder region of the bit outside of a nose region of the bit and adjacent a gage region of the bit.

16. A PDC bit, comprising:

a plurality of blades comprising a first blade of the plurality of blades including first primary PDC cutters set in a first primary cutter row and first backup PDC cutters set in a first secondary cutter row, and wherein a radial position of each first backup PDC cutter in the first secondary cutter row is offset from a radial position of each first primary PDC cutter in the first primary cutter row, and wherein the radial position of at least one first backup PDC cutter in the first secondary cutter row of the first blade radially positions said at least one first backup PDC cutter of the first blade with a peripheral edge exposed between adjacent ones of the first primary PDC cutters in the first primary cutter row of the first blade.

17. A method for setting PDC cutters on a bit including a plurality of blades, comprising:

defining a first primary cutter row and a first secondary cutter row on a first blade of the plurality of blades;

setting first primary PDC cutters on the first primary cutter row in accordance with a single set methodology; and setting first backup PDC cutters on the first secondary cutter row in accordance with a methodology wherein a radial position of each first backup PDC cutter in the first secondary cutter row is offset from a radial position of each first primary PDC cutter in the first primary cutter row and wherein at least one of the first primary PDC cutters only partially overlies a corresponding radially offset one of the secondary PDC cutters such that a peripheral edge of the radially offset secondary PDC cutter is exposed outside of the first primary PDC cutter in a bit profile of said first blade.

18. The method of claim 17, further comprising:

defining a first tertiary cutter row of the first blade of the plurality of blades;

setting first additional backup PDC cutters on the first tertiary cutter row in accordance with a methodology wherein a radial position of each first additional backup PDC cutter in the first tertiary cutter row is offset from a radial position of each first primary PDC cutter in the first primary cutter row.

19. The method of claim 17, further comprising:

defining a second primary cutter row and a second secondary cutter row on a second blade of the plurality of blades;

setting second primary PDC cutters on the second primary cutter row in accordance with the single set methodology; and setting second backup PDC cutters on the second secondary cutter row in accordance with a methodology wherein a radial position of each second backup PDC cutter in the second secondary cutter row is offset from a radial position of each second primary PDC cutter in the second primary cutter row.

20. The method of claim 19, wherein setting the second backup PDC cutters comprises setting the radial position of at least one second backup PDC cutter of the second blade with a peripheral edge exposed between adjacent ones of the first primary PDC cutters in the second primary cutter row of the second blade.

21. The method of claim 19, further comprising:

defining a tertiary cutter row of the second blade of the plurality of blades;

setting second additional backup PDC cutters on the tertiary cutter row in accordance with a methodology wherein a radial position of each second additional backup PDC cutter in the tertiary cutter row is offset from a radial position of each second primary PDC cutter in the second primary cutter row.

22. A method for setting PDC cutters on a bit including a plurality of blades, comprising:

defining a first primary cutter row and a first secondary cutter row on a first blade of the plurality of blades;

setting first primary PDC cutters on the first primary cutter row in accordance with a single set methodology; and setting first backup PDC cutters on the first secondary cutter row in accordance with a methodology wherein a radial position of each first backup PDC cutter in the first secondary cutter row is offset from a radial position of each first primary PDC cutter in the first primary cutter row;

wherein setting the first backup PDC cutters comprises setting the radial position of at least one first backup PDC cutter of the first blade with a peripheral edge exposed cutters between adjacent ones of the first primary PDC cutters in the first primary cutter row of the first blade.

* * * * *

UNITED STATES PATENT AND TRADEMARK OFFICE

CERTIFICATE OF CORRECTION

PATENT NO. : 8,544,568 B2
APPLICATION NO. : 12/960926
DATED : October 1, 2013
INVENTOR(S) : Cary Andrew Maurstad et al.

It is certified that error appears in the above-identified patent and that said Letters Patent is hereby corrected as shown below:

In the Claims:

At column 10, claim number 1, line number 35, please add the word -- cutter -- after the word "PDC".

At column 12, claim number 22, line number 62, please delete the word "cutters" after the word "PDC".

Signed and Sealed this
Twenty-first Day of June, 2016

Michelle K. Lee

Michelle K. Lee
*Director of the United States Patent and Trademark Office*